US011223140B2

(12) United States Patent
Lee et al.

(10) Patent No.: US 11,223,140 B2
(45) Date of Patent: Jan. 11, 2022

(54) ELECTRONICALLY-RECONFIGURABLE INTERDIGITAL CAPACITOR SLOT HOLOGRAPHIC ANTENNA

(71) Applicant: The Boeing Company, Chicago, IL (US)

(72) Inventors: Hanseung Lee, Thousand Oaks, CA (US); Ryan G. Quarfoth, Los Angeles, CA (US); Amit Madanlal Patel, Santa Monica, CA (US); James H. Schaffner, Chatsworth, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/854,790

(22) Filed: Apr. 21, 2020

(65) Prior Publication Data

US 2021/0328358 A1 Oct. 21, 2021

(51) Int. Cl.

| | |
|---|---|
| ***H01Q 19/06*** | (2006.01) |
| ***H01Q 3/34*** | (2006.01) |
| ***H01Q 13/10*** | (2006.01) |
| ***H01Q 1/22*** | (2006.01) |
| ***H01Q 1/36*** | (2006.01) |
| ***H01Q 1/50*** | (2006.01) |
| ***H01Q 3/38*** | (2006.01) |

(52) U.S. Cl.

CPC ..... *H01Q 19/067* (2013.01); *H01Q 1/2283* (2013.01); *H01Q 1/36* (2013.01); *H01Q 1/50* (2013.01); *H01Q 3/34* (2013.01); *H01Q 3/38* (2013.01); *H01Q 13/103* (2013.01); *H01Q 19/062* (2013.01)

(58) Field of Classification Search

CPC .... H01Q 13/103; H01Q 9/0407; H01Q 13/20; H01Q 13/206; H01Q 9/0442; H01Q 13/106; H01Q 13/26; H01Q 15/002; H01Q 15/0066; H01Q 19/067; H01Q 19/062; H01Q 1/50; H01Q 3/38; H01Q 1/36; H01Q 1/2283; B81B 2201/0221; H03H 7/004

See application file for complete search history.

(56) References Cited

U.S. PATENT DOCUMENTS

| | | | | |
|---|---|---|---|---|
| 9,853,361 | B2 * | 12/2017 | Chen | H01P 7/082 |
| 10,236,574 | B2 * | 3/2019 | Chen | H01Q 19/067 |
| 10,673,145 | B2 * | 6/2020 | Hyde | H01Q 15/0086 |
| 10,811,782 | B2 * | 10/2020 | Quarfoth | H01Q 3/44 |
| 2012/0092217 | A1 * | 4/2012 | Hosoya | H04B 7/086 342/373 |

(Continued)

*Primary Examiner* — Vibol Tan

(74) *Attorney, Agent, or Firm* — Sage Patent Group

(57) ABSTRACT

A holographic antenna includes a transmission line and a plurality of interdigital capacitor (IDC) slots respectively formed along the transmission line. The holographic antenna also includes an active tuning device connected to each IDC slot from the plurality of IDC slots. Each active tuning device is configured to provide a holographic pattern on the plurality of IDC slots in response to the holographic antenna transmitting or receiving an electromagnetic signal. The holographic pattern is controllable for scanning an electromagnetic beam by the holographic antenna. The holographic antenna also includes a biasing source coupled to each active tuning device and configured to control its respective operation.

21 Claims, 8 Drawing Sheets

(56) References Cited

U.S. PATENT DOCUMENTS

| | | | | |
|---|---|---|---|---|
| 2015/0236412 | A1* | 8/2015 | Bily | H01Q 21/20<br>342/374 |
| 2020/0053490 | A1* | 2/2020 | Shriner | H01Q 1/273 |
| 2020/0083605 | A1* | 3/2020 | Quarfoth | H01Q 13/103 |

* cited by examiner

ELECTRONICALLY-RECONFIGURABLE INTERDIGITAL CAPACITOR SLOT HOLOGRAPHIC ANTENNA

FIELD

The present disclosure relates generally to antennas, and more particularly to an electronically-reconfigurable interdigital capacitor slot holographic antenna.

BACKGROUND

A holographic antenna includes a radiating aperture, such as a linear slot. A hologram is built by the radiating aperture being fed by an electromagnetic wave traveling on a thin substrate. The hologram can be described as an interference pattern of the superposition of the wave on a holographic surface. Therefore, a beam direction and beam shape of a radiation beam radiating from the holographic antenna can be controlled by modification of the hologram form. However, linear slot holographic antennas have limited leakage capability because of intrinsic boundary conditions. Therefore, linear slot holographic antennas exhibit poor antenna aperture efficiency and only have radiation when a switch controlling the antenna is off.

SUMMARY

In accordance with an example, a holographic antenna includes a transmission line and a plurality of interdigital capacitor (IDC) slots respectively formed along the transmission line. The holographic antenna also includes an active tuning device connected to each IDC slot from the plurality of IDC slots. Each active tuning device is configured to provide a holographic pattern on the plurality of IDC slots in response to the holographic antenna transmitting or receiving an electromagnetic signal. The holographic pattern is controllable for scanning an electromagnetic beam by the holographic antenna. The holographic antenna also includes a biasing source coupled to each active tuning device and configured to control its respective operation.

In accordance with another example, a holographic antenna includes an array of holographic antenna elements. Each holographic antenna element includes a transmission line and a plurality of interdigital capacitor (IDC) slots respectively formed along the transmission line. The holographic antenna also includes an active tuning device connected to each IDC slot from the plurality of IDC slots. Each active tuning device is configured to provide a holographic pattern on the plurality of IDC slots in response to the array of holographic antenna elements receiving or transmitting an electromagnetic signal. The holographic pattern is controllable for scanning an electromagnetic beam by the holographic antenna. The holographic antenna also includes a biasing source coupled to each active tuning device and configured to control its respective operation. The holographic antenna additionally includes a plurality of adjustable phase shifters. Each adjustable phase shifter from the plurality of adjustable phase shifters is electrically connected to an end of each holographic antenna element from the array of holographic antenna elements and is configured to couple a transmitter, a receiver, or a transceiver to each holographic antenna element. The plurality of adjustable phase shifters are adjustable to provide electromagnetic beam steering by the array of holographic antenna elements.

In accordance with another example, a method for reconfiguring a holographic antenna includes providing a holographic antenna. The holographic antenna includes a transmission line and a plurality of interdigital capacitor (IDC) slots respectively formed along the transmission line. The holographic antenna also includes an active tuning device connected to each IDC slot from the plurality of IDC slots. Each active tuning device is configured to provide a holographic pattern on the plurality of IDC slots in response to the holographic antenna transmitting or receiving an electromagnetic signal. The holographic antenna additionally includes controlling the holographic pattern on the plurality of IDC slots to scan an electromagnetic beam by the holographic antenna in response to the holographic antenna transmitting or receiving the electromagnetic signal. Said controlling the holographic pattern on the plurality of IDC slots includes controlling operation of each active tuning device.

In accordance with an example and any of the preceding examples, wherein the transmission line includes one of a rectangular waveguide or a circular waveguide.

In accordance with an example and any of the preceding examples, wherein the plurality of IDC slots are located periodically along the transmission line.

In accordance with an example and any of the preceding examples, wherein the transmission line is configured to operate between about 8 Gigahertz and about 18 Gigahertz, and wherein the transmission line includes a length of about six wavelengths at a center frequency of about 12 Gigahertz.

In accordance with an example and any of the preceding examples, wherein each IDC slot includes a predetermined slit size, and wherein an amount of electromagnetic radiation or signal leakage from a particular IDC slot is controlled by changing the predetermined slit size of the particular IDC slot.

In accordance with an example and any of the preceding examples, wherein the holographic antenna comprises an array of holographic antenna elements, and wherein an electromagnetic target beam is configured to be formed by synthesizing the amount of signal leakage from each of the IDC slots in the array of holographic antenna elements.

In accordance with an example and any of the preceding examples, wherein each IDC slot includes a substantially serpentine shape.

In accordance with an example and any of the preceding examples, wherein each IDC slot comprises a square-wave shape.

In accordance with an example and any of the preceding examples, wherein each active tuning device is an electronic switch device, and wherein each electronic switch device has an ON state and an OFF state.

In accordance with an example and any of the preceding examples, wherein each electronic switch device is configured to: electrically connect one side of its IDC slot to an opposite side of its IDC slot when in the ON state; and electrically disconnect the one side and the opposite side of its IDC slot when in the OFF state.

In accordance with an example and any of the preceding examples, wherein each IDC slot is configured to provide signal leakage or electromagnetic radiation when the electronic switch device is in either the ON state or the OFF state.

In accordance with an example and any of the preceding examples, wherein the biasing source is further configured to operate each electronic switch device between the ON state and the OFF state.

In accordance with an example and any of the preceding examples, wherein the active tuning devices connected to the plurality of IDC slots are tunable to reconfigure an electromagnetic beam pattern of the holographic antenna.

The features, functions, and advantages that have been discussed can be achieved independently in various examples or may be combined in yet other examples further details of which can be seen with reference to the following description and drawings.

DETAILED DESCRIPTION

Figure 1:
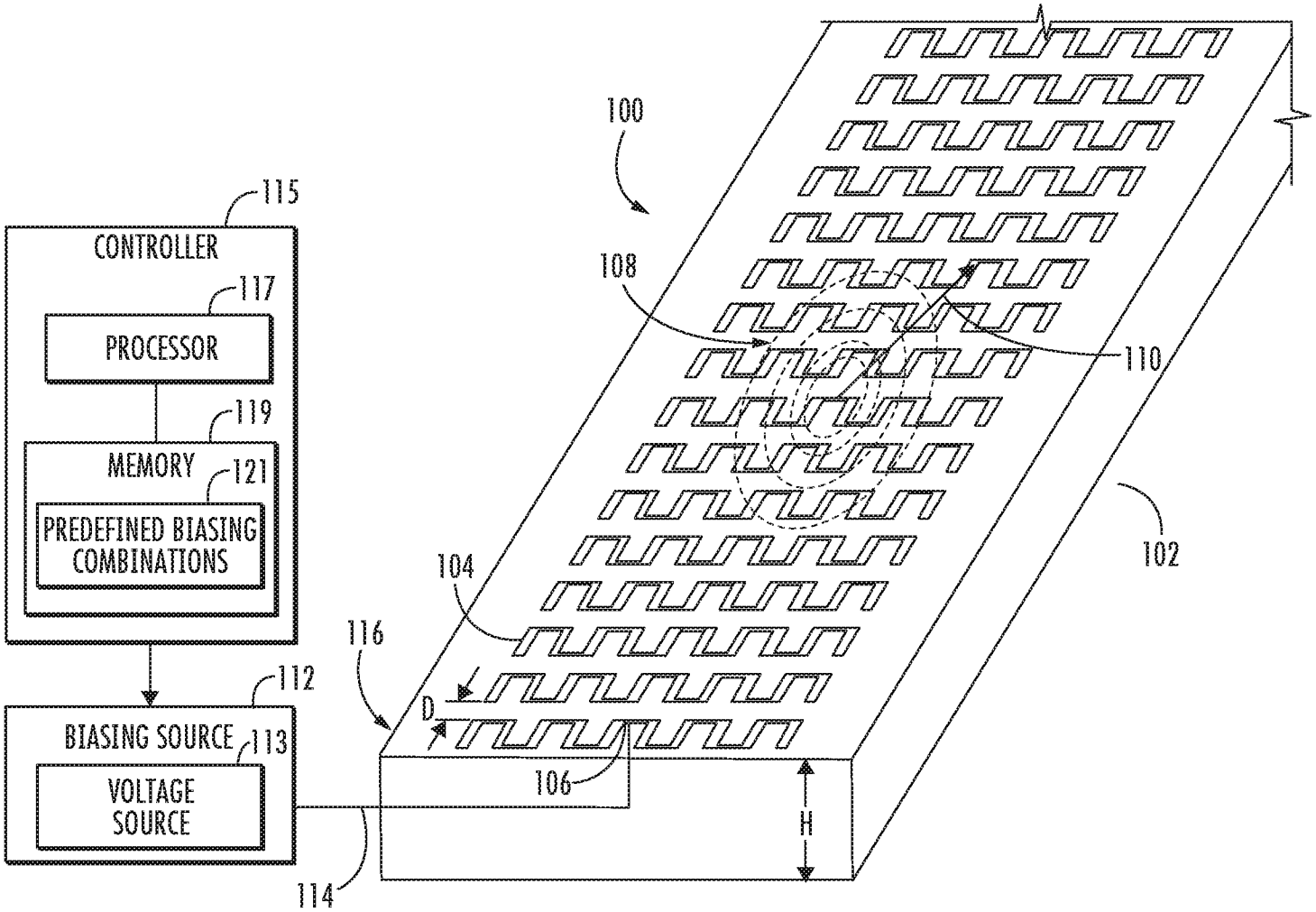
FIG. 1 is a perspective view of an interdigital capacitor slot holographic antenna in accordance with an example of the present disclosure.

The following detailed description of examples refers to the accompanying drawings, which illustrate specific examples of the disclosure. Other examples having different structures and operations do not depart from the scope of the present disclosure. Like reference numerals may refer to the same element or component in the different drawings.

FIG. 1 is a perspective view of an interdigital capacitor slot holographic antenna 100 in accordance with an example of the present disclosure. The holographic antenna 100 includes a transmission line 102 and a plurality of interdigital capacitor (IDC) slots 104 respectively formed along the transmission line 102. The holographic antenna 100 also includes an active tuning device 106 connected to each IDC slot 104 from the plurality of IDC slots 104. Each active tuning device 106 is configured to provide a holographic pattern 108 on the plurality of IDC slots 104 in response to the holographic antenna 100 transmitting or receiving an electromagnetic signal. The holographic pattern 108 is controllable for scanning an electromagnetic beam 110 by the holographic antenna 100. The holographic antenna 100 additionally includes a biasing source 112 coupled to each active tuning device 106 and configured to control its respective operation. An example of the biasing source 112 is a voltage source 113. The biasing source 112 is electrically connected to the active tuning device 106 by a biasing line 114, for example, an electric conductor. Each active tuning device 106 is controlled by its own biasing source 112. Only a single biasing source 112 is shown in FIG. 1 for purposes of clarity. A controller 115 is connected to each of the biasing sources 112. The controller 115 is configured to control operation of each of the biasing sources 112 for turning on or off each of the active tuning devices 106 in a particular order to control scanning the electromagnetic beam 110 as described herein. The controller 115 includes a processor 117 and an associated memory 119. The memory 119 includes predefined biasing combinations 121. The predefined biasing combinations 121 are used by the processor 117 to control operation of each of the biasing sources 112 for tuning on or off each of the active tuning devices 106 in the particular order based on a particular predefined biasing combination 121.

Examples of the transmission line 102 include but are not necessarily limited to waveguides. In some examples, the transmission line 102 is a substrate integrated waveguide (SIW) or post-wall waveguide. A substrate integrated waveguide is a synthetic waveguide formed in a dielectric substrate by densely arraying metallized posts or via holes which connect upper and lower plates of the substrate. Examples of the transmission line 102 include waveguides of any cross-sectional shape. In the example illustrated in FIG. 1, the transmission line 102 includes a rectangular substrate integrated waveguide. In other examples, the transmission line 102 includes a circular waveguide. In accordance with an example, the transmission line 102 is configured to operate between about 8 Gigahertz and about 18 Gigahertz, and the transmission line 102 includes a length of about six wavelengths at a center frequency of about 12 Gigahertz. Accordingly, the rectangular waveguide in the example in FIG. 1 includes dimensions to operate between about 8 Gigahertz and about 18 Gigahertz, and the waveguide includes a length of about six wavelengths at a center frequency of about 12 Gigahertz.

In some examples, the plurality of IDC slots 104 are located periodically along the transmission line 102 or are at a preset uniform distance "D" apart. In some examples, each IDC slot 104 includes a substantially serpentine shape. In the example illustrated in FIG. 1, each IDC slot 104 includes a square-wave shape. Other non-linear shapes are also usable for the IDC slots 104.

Figure 2:
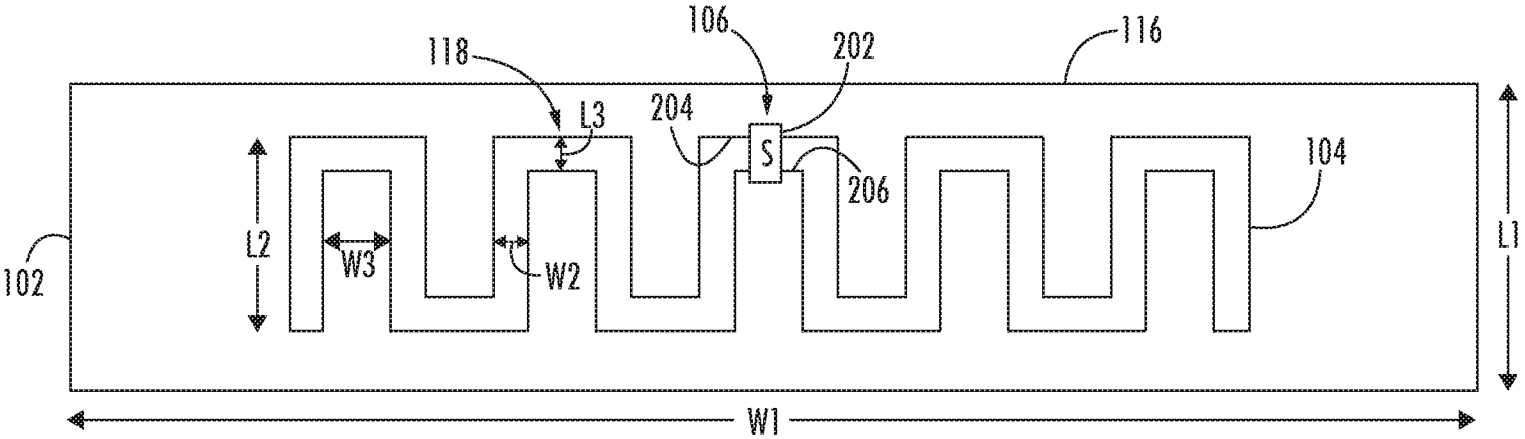
FIG. 2 is a plane view of an example of a unit cell of the exemplary holographic antenna of FIG. 1.
Figure 4:
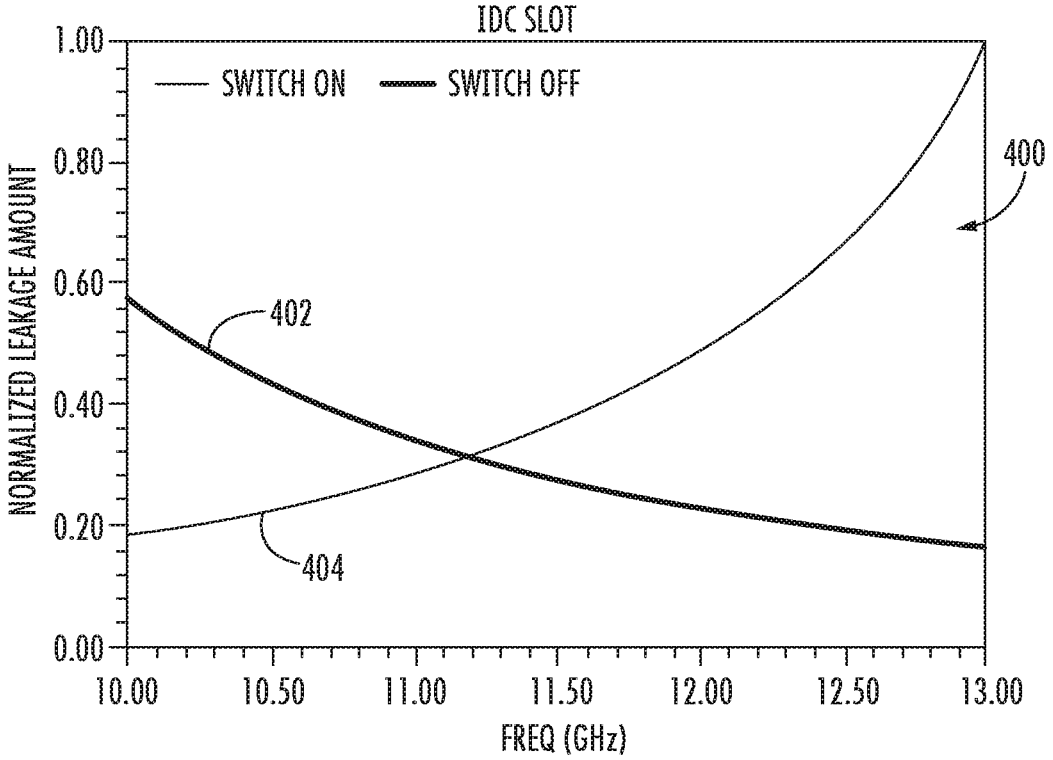
FIG. 4 is a graph of normalized signal leakage for an exemplary IDC slot in accordance with an example of the present disclosure.

Referring also to FIG. 2, FIG. 2 is a plane view of an example of a unit cell 116 of the holographic antenna 100 of FIG. 1. The unit cell 116 includes an interdigital capacitor (IDC) slot 104. The holographic antenna 100 in FIG. 1 includes a plurality of unit cells 116 each including an IDC slot 104. In some examples, each active tuning device 106 is an electronic switch device (S) 202 as illustrated in FIG. 2. Each electronic switch device 202 has an ON state and an OFF state. Each electronic switch device 202 is configured to: electrically connect one side 204 of its IDC slot 104 to an opposite side 206 of its IDC slot 104 when in the ON state; and electrically disconnect the one side 204 and the opposite side 206 of its IDC slot 104 when the electronic switch device 202 is in the OFF state. Each IDC slot 104 is configured to provide signal leakage or electromagnetic radiation when the electronic switch device 202 is in either the ON state or the OFF state. The biasing source 112 is further configured to operate each electronic switch device 202 between the ON state and the OFF state. Referring also to FIG. 4, FIG. 4 is a graph of normalized signal leakage 400 for an exemplary IDC slot 104 in accordance with an example of the present disclosure. As illustrated in FIG. 4, the exemplary IDC slot 104 exhibits signal leakage 400 in both the ON state and the OFF state. The signal leakage 402 of the switch OFF state (active tuning device 106 is OFF) exhibits an inverse relationship relative to the signal leakage 404 of the switch ON state (active tuning device 106 is ON). The signal leakage 402 of the switch OFF state decreases as the frequency increases and the signal leakage 404 of the switch ON state increase as the frequency increases. In contrast, a linear slot holographic antenna only has signal leakage when the active tuning device is switched off. Therefore, the IDC slot holographic antenna 100 provides improved aperture efficiency compared to a linear slot holographic antenna.

Figure 3:
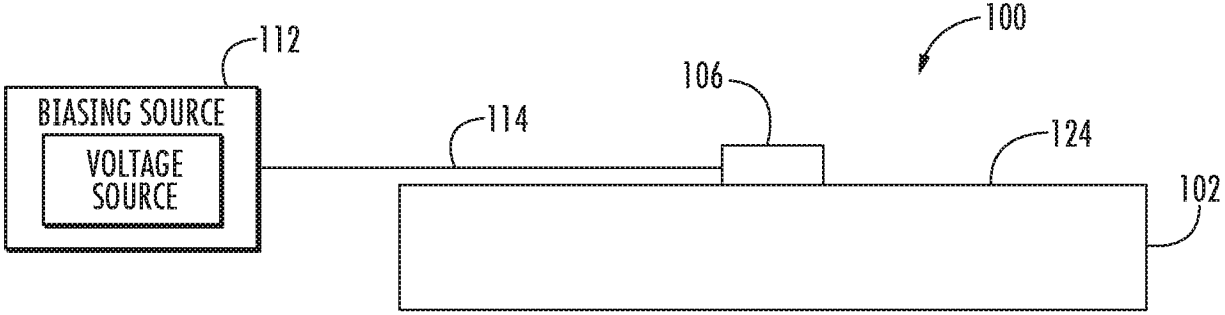
FIG. 3 is an end view of the interdigital capacitor slot holographic antenna of FIG. 1.
Figure 5:
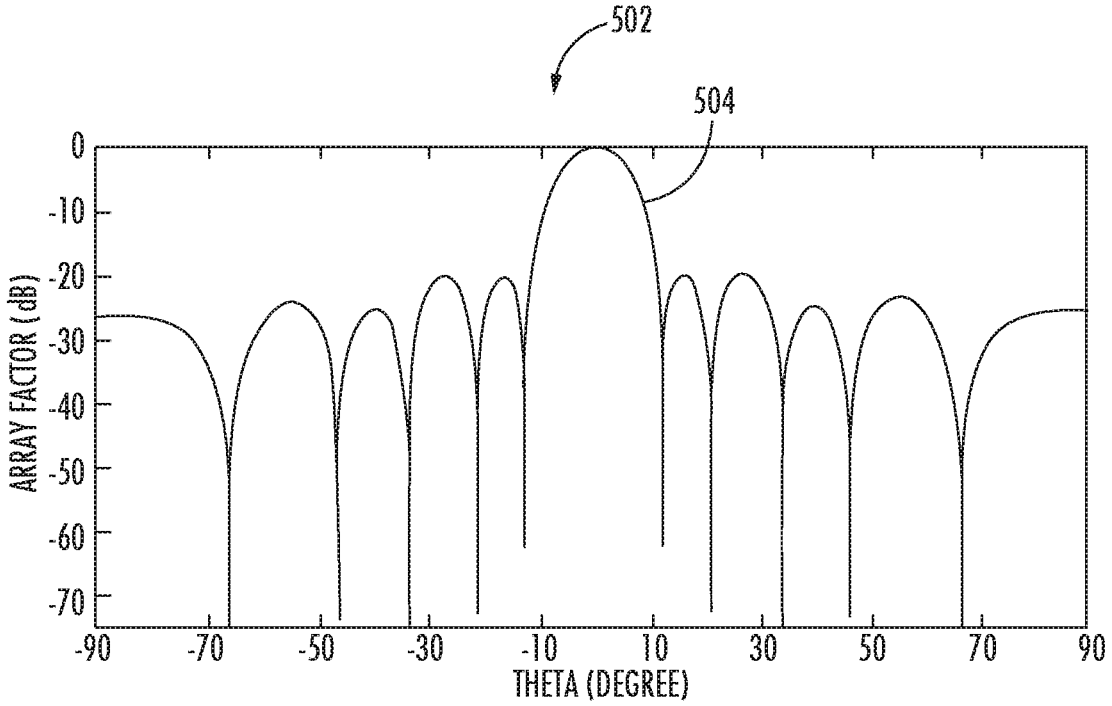
FIG. 5 is an illustration of an example of an electromagnetic beam pattern of an IDC slot holographic antenna in accordance with an example of the present disclosure.

FIG. 3 is an end view of the interdigital capacitor slot holographic antenna 100 of FIG. 1. In the example of FIG. 3, the active tuning devices 106 are located on a top surface 124 of the transmission line 102 or waveguide, and each active tuning device 106 is configured to connect opposite sides 204 and 206 of an associated IDC slot 104 as shown in FIG. 2. In other examples, the active tuning devices 106 are located on any surface of the transmission line 102 or waveguide where the IDC slots 104 are located. Examples of the active tuning devices 106 include, but are not necessarily limited to, a field effect transistor (FET), a PIN diode, a Pulse Code Modulation (PCM) switch, a Micro-Electro-Mechanical System (MEMS) switch or any two-state (ON/OFF) switch device. A biasing line 114 electrically connects each active tuning device 106 to an associated biasing source 112. An example of each biasing source 112 is a voltage source 113 for turning the associated active tuning device 106 to the ON state to connect the opposite sides 204 and 206 of the IDC slot 104, or turning the active tuning device 106 to the OFF state to disconnect the opposite sides 204 and 206 of the IDC slot 104. The biasing lines 114 are located outside the transmission line 102 or waveguide, as illustrated in the example of FIG. 3, or in other examples extend within the transmission line 102 or waveguide. The active tuning devices 106 connected to the IDC slots 104 are tunable to reconfigure an electromagnetic beam pattern 502 (FIG. 5) of the holographic antenna 100. An example of an electromagnetic beam pattern 502 is illustrated in FIG. 5. For example, the active tuning devices 106 are switched either ON or OFF in a particular order along the length of the transmission line 102 to reconfigure the electromagnetic beam pattern 502 of the holographic antenna 100. Turning the active tuning devices 106 either ON or OFF in the particular order provides an artificial impedance surface on the transmission line 102 or waveguide. A radio frequency (RF) interference caused by the unique artificial impedance surface provides three-dimensional antenna patterns or electromagnetic radiation patterns generated by the holographic antenna 100, e.g., electromagnetic beam pattern 502 in FIG. 5.

Figure 6:
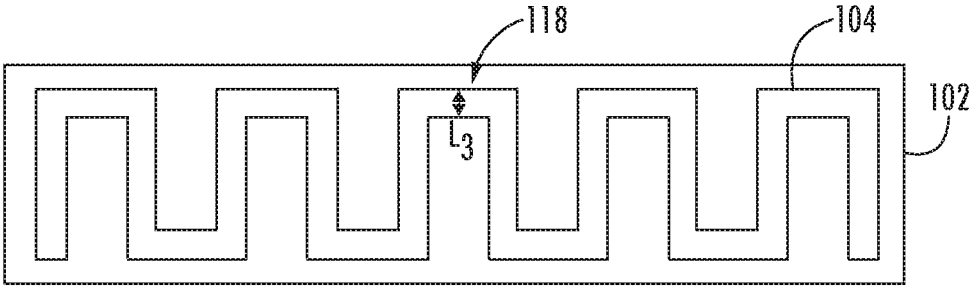
FIG. 6 illustrates graphs of normalized signal leakage amounts based on different slit sizes of exemplary IDC slots in accordance with an example of the present disclosure.
Figure 6:
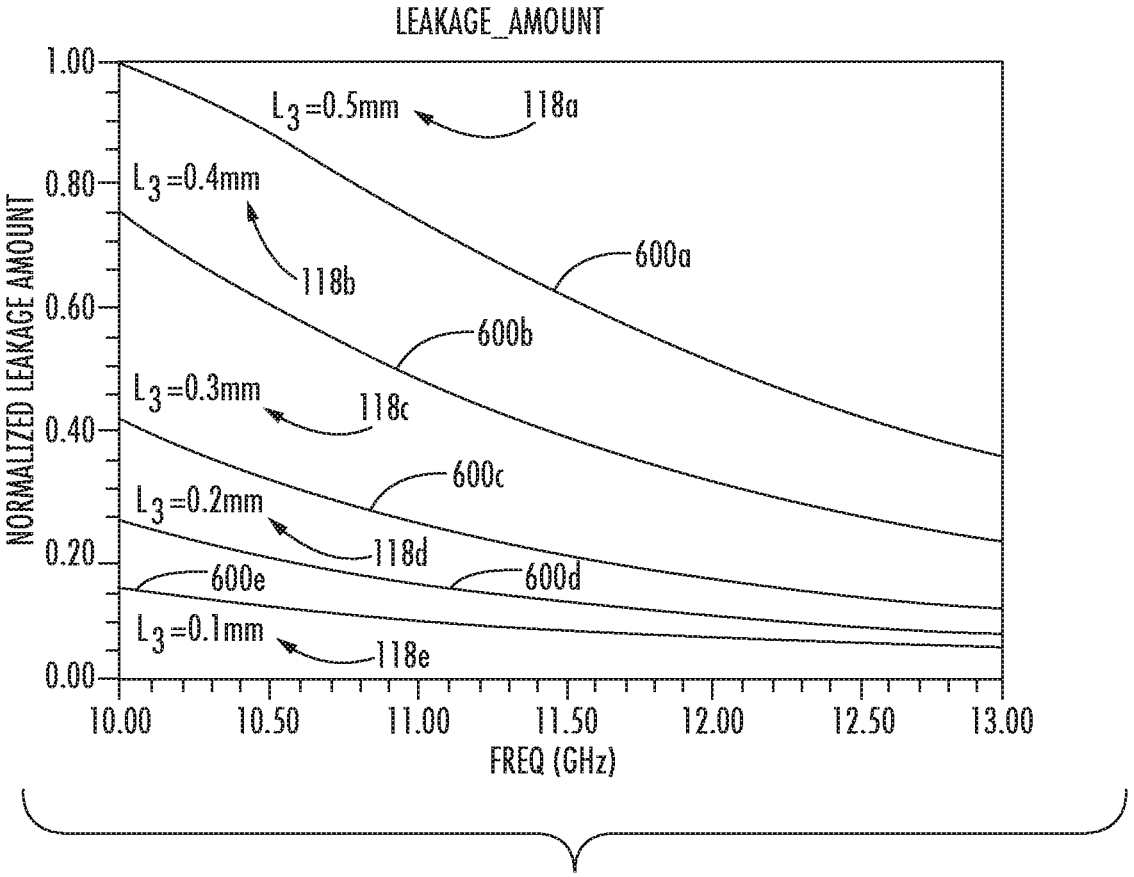

Referring back to FIG. 2, each IDC slot 104 includes a predetermined slit size 118 (L3) or spacing between opposite sides 204 and 206 of the IDC slot 104. An amount of electromagnetic radiation or signal leakage from a particular IDC slot 104 is controlled by changing the predetermined slit size 118 (L3) of the particular IDC slot 104. Referring also to FIG. 6, FIG. 6 illustrates graphs of normalized signal leakage 600*a*-600*e* amounts based on different slit sizes 118*a*-118*e* of exemplary IDC slots 104 in accordance with an example of the present disclosure. As illustrated in FIG. 6, the graph of normalized signal leakage 600 is higher the greater the slit size 118 (L3). The graph of normalize signal leakage 600*a*-600*e* for each slit size 118*a*-118*e* decreases as the frequency increases. In some examples, a holographic antenna, such as holographic antenna 100 in FIG. 1, includes an array of holographic antennas 100 or holographic antenna elements. As described in more detail with reference to FIG. 9, an exemplary holographic antenna 900 includes an array of holographic antenna elements 902. In some examples, the holographic antenna 100 is used for each of the holographic antenna elements 902. An electromagnetic target beam is configured to be formed by synthesizing the amounts of signal leakage 402-404 (FIG. 4) from each of the IDC slots 104 in the array of holographic antenna elements 902. An example of an electromagnetic target beam 504 is illustrated in FIG. 5.

An example of the holographic antenna 100 and IDC slot 104, as illustrated in FIG. 2, includes the following parameters: a unit cell length (L1) of about 2.2 millimeters; a unit cell width (W1) of about 10 millimeters; a slot length (L2) of about 1.4 millimeters; a slot width (W2) of about 0.25 millimeters; a slit size (L3) of about 0.2 millimeters; and a slot gap (W3) of about 0.5 millimeters. The transmission line 102 or waveguide of an example of the holographic antenna 100 includes a height ("H" shown in FIG. 1) of about 110 millimeters and a dielectric constant of about 3.55. The transmission line 102 or waveguide is a conductive material, for example a metal such as copper, although other conductive materials are also useable. The parameters of the exemplary holographic antenna 100 and IDC slot 104 are determined by simulation to provide a desired electromagnetic radiation response or radiation pattern. In accordance with an example, as previously described, the transmission line 102 is configured or includes dimensions to operate between about 8 Gigahertz and about 18 Gigahertz, and the transmission line 102 or waveguide includes a length of about six wavelengths at a center frequency of about 12 Gigahertz. These parameters are changeable depending on a particular operating frequency band and antenna materials.

Figure 8:
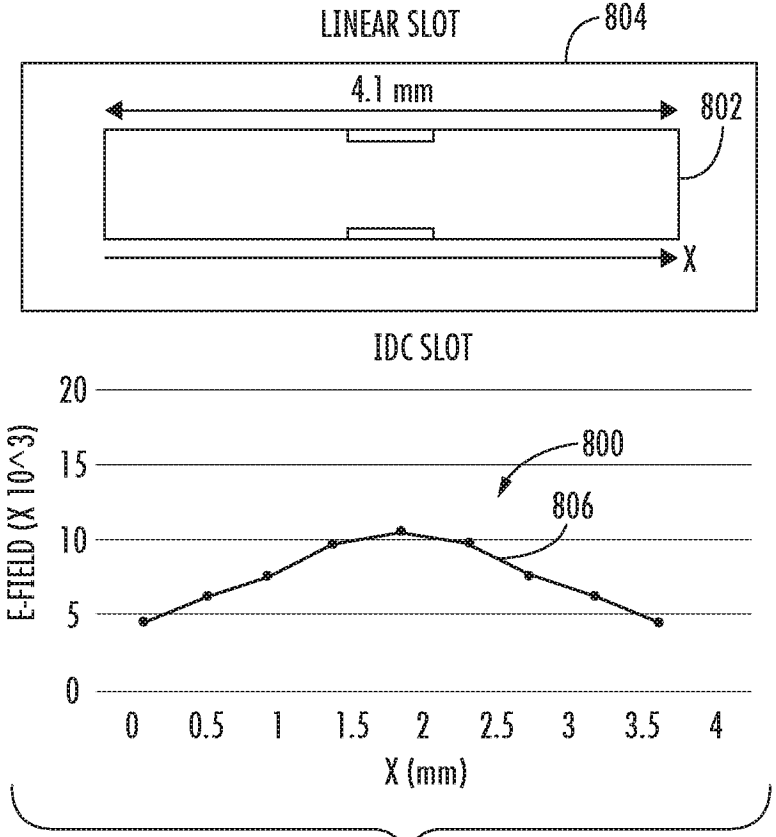
FIG. 8 is a graph of electric field (E-Field) intensities across an exemplary linear slot of a holographic antenna in accordance with an example of the present disclosure.
Figure 7:
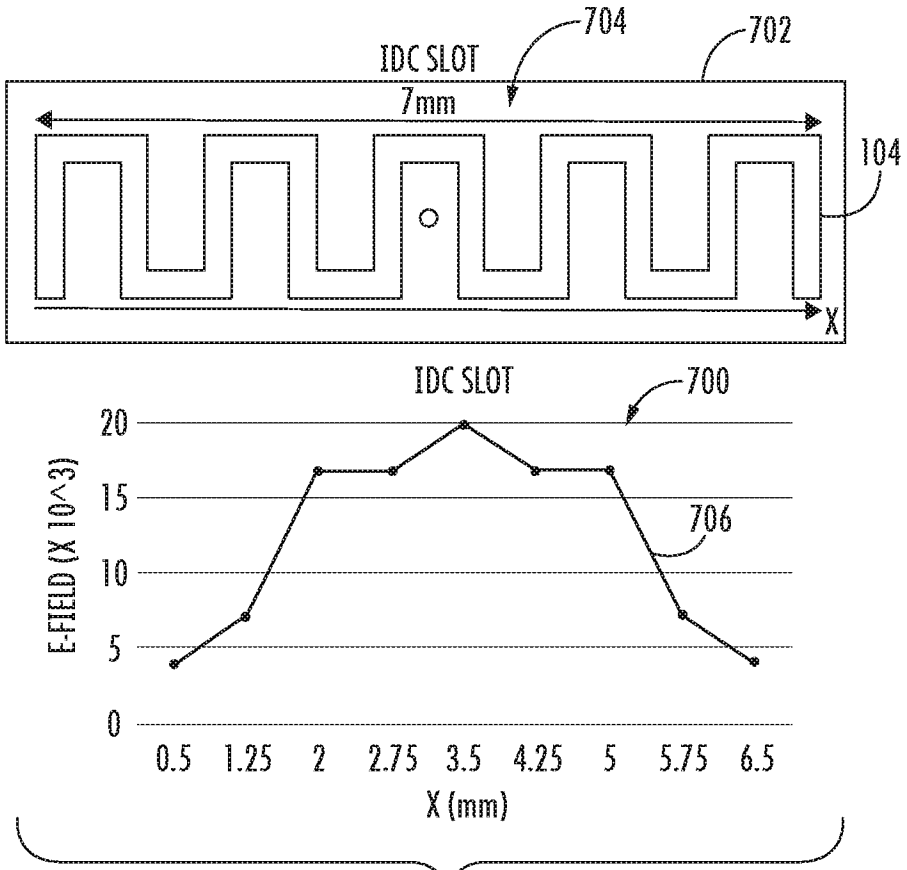
FIG. 7 is a graph of electric field (E-Field) intensities across an exemplary interdigital capacitor (IDC) slot of a holographic antenna in accordance with an example of the present disclosure.

Referring to FIGS. 7 and 8, FIG. 7 is a graph of electric field (E-Field) intensities 700 across an exemplary interdigital capacitor (IDC) slot 104 of a holographic antenna 702 in accordance with an example of the present disclosure. FIG. 8 is a graph of electric field (E-Field) intensities 800 across an exemplary linear slot 802 of a holographic antenna 804 in accordance with an example of the present disclosure. By comparison, the IDC slot 104 has higher or stronger electric field intensities 700 than the linear slot 802. In addition, the profile of the electric field intensities or signal leakage profile 706 of the IDC slot 104 slot is substantially flat across a middle portion 704 of the IDC slot 104 where the electric field intensities 700 are highest. The linear slot 802 exhibits a more sinusoidal electric field distribution or signal leakage profile 806 than the IDC slot 104. Because the IDC slot 104 has stronger electric field intensities 700 and a flatter signal leakage profile 706, the IDC slot 104 provides improved aperture efficiency and higher gain compared to the linear slot 802.

Figure 9:
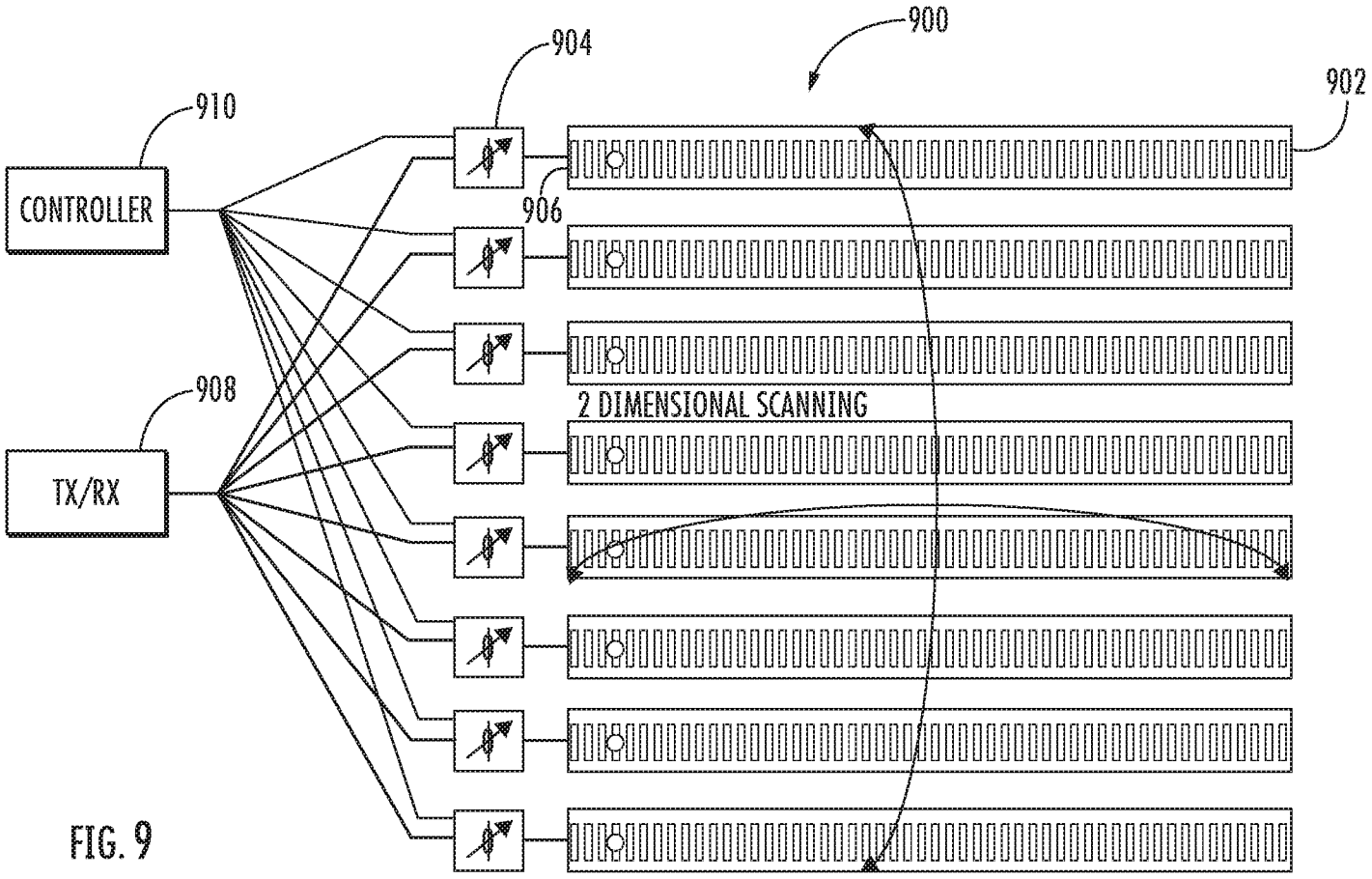
FIG. 9 is a schematic diagram of an example of a holographic antenna in accordance with an example of the present disclosure.

FIG. 9 is a schematic diagram of an example of a holographic antenna 900 in accordance with an example of the present disclosure. The holographic antenna 900 is configured to perform two-dimensional scanning as illustrated in FIG. 9. The holographic antenna 900 includes an array of holographic antenna elements 902. In accordance with an example, each of the holographic antenna element 902 is the same as the holographic antenna 100 described with reference to FIGS. 1-3. The holographic antenna 900 also includes a plurality of adjustable phase shifters 904. Each adjustable phase shifter 904 from the plurality of adjustable phase shifters 904 is electrically connected to an end 906 of each holographic antenna element 902 from the array of holographic antenna elements 902 and is configured to couple a transmitter, a receiver, or a transceiver 908 to each holographic antenna element 902. The plurality of adjustable phase shifters 904 are adjustable to provide electromagnetic beam steering by the array of holographic antenna elements 902.

The IDC slot 104 of each holographic antenna element 902 includes a predetermined slit size 118 (L3) as previously described with reference to FIG. 2. An amount of electromagnetic radiation or signal leakage from a particular IDC slot 104 is controlled by changing the predetermined slit size 118 (L3) of the particular IDC slot 104 as previously described with reference to FIG. 6. An electromagnetic target beam, such as electromagnetic target beam 504 (FIG. 5) is configured to be formed by synthesizing the amounts of signal leakage from each of the IDC slots 104 in the array of holographic antenna elements 902. The holographic antenna 900 also includes a controller 910 electrically connected to each of the adjustable phase shifters 904 to adjust a response of each adjustable phase shifter 904 for steering the electromagnetic target beam 504.

Figure 10:
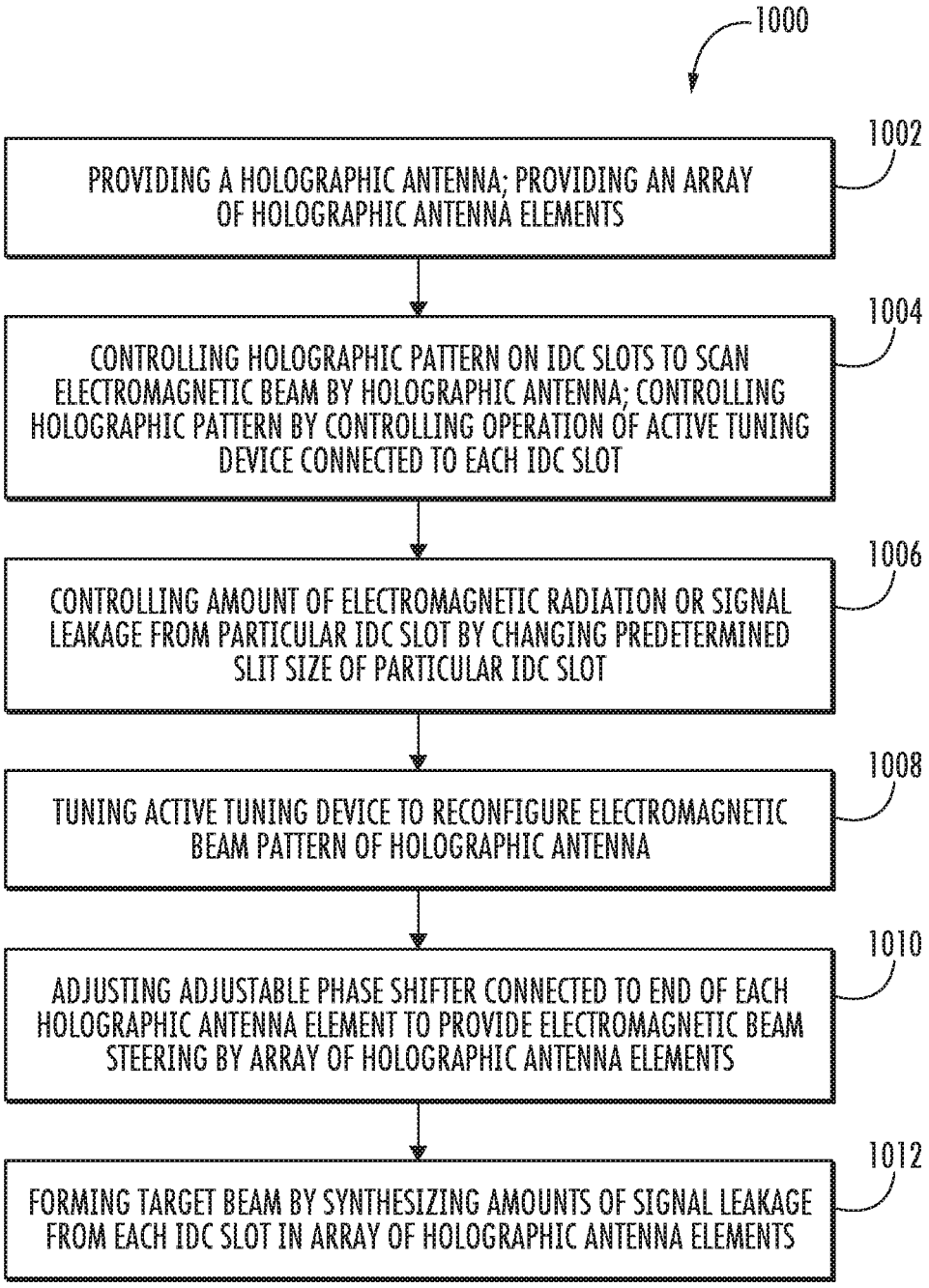
FIG. 10 is a flow chart of an example of a method for reconfiguring a holographic antenna to steer an electromagnetic target beam in accordance with an example of the present disclosure.

FIG. 10 is a flow chart of an example of a method 1000 for reconfiguring a holographic antenna to steer an electromagnetic target beam in accordance with an example of the present disclosure. In accordance with some examples, the method 1000 is used to reconfigure the holographic antenna 100 or 900 to steer an electromagnetic target beam, e.g., electromagnetic target beam 504 in FIG. 5. In block 1002, the method 1000 includes providing a holographic antenna, e.g., holographic antenna 100 or 900. In some examples, providing the holographic antenna also includes providing an array of holographic antenna elements, such as holographic antenna elements 902 in FIG. 9. The holographic antenna 100 or 900 includes a transmission line 102 and a plurality of interdigital capacitor (IDC) slots 104 respectively formed along the transmission line 102. The holographic antenna 100 or 900 also includes an active tuning device 106 connected to each IDC slot 104 from the plurality of IDC slots. Each active tuning device 106 is configured to provide a holographic pattern 108 on the plurality of IDC slots 104 in response to the holographic antenna 100 or 900 transmitting or receiving an electromagnetic signal.

In block 1004, the method 1000 includes controlling the holographic pattern 108 on the plurality of IDC slots 104 to scan an electromagnetic beam 110 by the holographic antenna 100 or 900 in response to the holographic antenna 100 or 900 transmitting or receiving the electromagnetic signal. Controlling the holographic pattern 108 of the plurality of IDC slots 104 includes controlling operation of the active tuning device 106 connected to each IDC slot 104.

As previously described, each IDC slot 104 includes a predetermined slit size 118 (L3 in FIG. 2). In block 1006, the method 1000 further includes controlling an amount of electromagnetic radiation or signal leakage from a particular IDC slot 104 by changing the predetermined slit size 118 of the particular IDC slot 104.

In block 1008, the method 1000 includes tuning the active tuning devices 106 connected to the IDC slots 104 to reconfigure an electromagnetic beam pattern 502 (FIG. 5) of the holographic antenna 100 or 900.

In some examples where the holographic antenna 900 includes an array of holographic antenna elements 902, in block 1010, the method 1000 includes adjusting an adjustable phase shifter 904 connected to an end 906 of each holographic antenna element 902 to provide electromagnetic beam steering by the array of holographic antenna elements 902.

In block 1012, the method 1000 includes forming an electromagnetic target beam 504 (FIG. 5) by synthesizing amounts of signal leakage from each of the IDC slots 104 in the array of holographic antenna elements 902.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of embodiments of the disclosure. As used herein, the singular forms "a", "an," and "the" are intended to include the plural forms as well, unless the context clearly indicates otherwise. It will be further understood that the terms "include," "includes," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present embodiments has been presented for purposes of illustration and description but is not intended to be exhaustive or limited to embodiments in the form disclosed. Many modifications and variations will be apparent to those of ordinary skill in the art without departing from the scope and spirit of embodiments.

Although specific embodiments have been illustrated and described herein, those of ordinary skill in the art appreciate that any arrangement which is calculated to achieve the same purpose may be substituted for the specific embodiments shown and that the embodiments have other applications in other environments. This application is intended to cover any adaptations or variations. The following claims are in no way intended to limit the scope of embodiments of the disclosure to the specific embodiments described herein.

What is claimed is:

1. A holographic antenna, comprising:

a transmission line;

a plurality of interdigital capacitor (IDC) slots respectively formed along the transmission line;

a single active tuning device connected to each IDC slot of the plurality of IDC slots, wherein each active tuning device is configured to provide a holographic pattern on the plurality of IDC slots in response to the holographic antenna transmitting or receiving an electromagnetic signal, and wherein the holographic pattern is controllable for scanning an electromagnetic beam by the holographic antenna; and a biasing source coupled to each active tuning device and configured to control its respective operation.

2. The holographic antenna of claim 1, wherein the transmission line comprises one of a rectangular waveguide or a circular waveguide.

3. The holographic antenna of claim 1, wherein the plurality of IDC slots are located periodically along the transmission line.

4. The holographic antenna of claim 1, wherein the transmission line is configured to operate between about 8 Gigahertz and about 18 Gigahertz, and wherein the transmission line comprises a length of about six wavelengths at a center frequency of about 12 Gigahertz.

5. The holographic antenna of claim 1, wherein each IDC slot comprises a predetermined slit size, and wherein an amount of electromagnetic radiation or signal leakage from a particular IDC slot is controlled by changing the predetermined slit size of the particular IDC slot.

6. The holographic antenna of claim 5, wherein the holographic antenna comprises an array of holographic antenna elements, and wherein an electromagnetic target beam is configured to be formed by synthesizing the amount of signal leakage from each of the IDC slots in the array of holographic antenna elements.

7. The holographic antenna of claim 1, wherein each IDC slot comprises a substantially serpentine shape.

8. The holographic antenna of claim 1, wherein each IDC slot comprises a square-wave shape.

9. The holographic antenna of claim 1, wherein each active tuning device is an electronic switch device, and wherein each electronic switch device has an ON state and an OFF state.

10. The holographic antenna of claim 9, wherein each electronic switch device is configured to:

electrically connect one side of its IDC slot to an opposite side of its IDC slot when in the ON state; and electrically disconnect the one side and the opposite side of its IDC slot when in the OFF state.

11. The holographic antenna of claim 9, wherein each IDC slot is configured to provide signal leakage or electromagnetic radiation when the electronic switch device is in either the ON state or the OFF state.

12. The holographic antenna of claim 9, wherein the biasing source is further configured to operate each electronic switch device between the ON state and the OFF state.

13. The holographic antenna of claim 1, wherein the active tuning devices connected to the plurality of IDC slots are tunable to reconfigure an electromagnetic beam pattern of the holographic antenna.

14. The holographic antenna of claim 1, further comprising:

an array of holographic antenna elements; and a plurality of adjustable phase shifters, wherein each adjustable phase shifter from the plurality of adjustable phase shifters is connected to an end of each holographic antenna element from the array of holographic antenna elements and is configured to couple a transmitter, a receiver, or a transceiver to each of the holographic antenna elements, and wherein the plurality of adjustable phase shifters are adjustable to provide electromagnetic beam steering by the array of holographic antenna elements.

15. A holographic antenna, comprising:

an array of holographic antenna elements, each holographic antenna element comprising:

a transmission line;

a plurality of interdigital capacitor (IDC) slots respectively formed along the transmission line;

a single active tuning device connected to each IDC slot of the plurality of IDC slots, wherein each active tuning device is configured to provide a holographic pattern on the plurality of IDC slots in response to the array of holographic antenna elements receiving or transmitting an electromagnetic signal, and wherein the holographic pattern is controllable for scanning an electromagnetic beam by the holographic antenna; and a biasing source coupled to each active tuning device and configured to control its respective operation; and a plurality of adjustable phase shifters, wherein each adjustable phase shifter from the plurality of adjustable phase shifters is electrically connected to an end of each holographic antenna element from the array of holographic antenna elements and is configured to couple a transmitter, a receiver, or a transceiver to each holographic antenna element, and wherein the plurality of adjustable phase shifters are adjustable to provide electromagnetic beam steering by the array of holographic antenna elements.

16. The holographic antenna of claim 15, wherein each IDC slot comprises a predetermined slit size, and wherein an amount of electromagnetic radiation or signal leakage from a particular IDC slot is controlled by changing the predetermined slit size of the particular IDC slot.

17. A method for reconfiguring a holographic antenna, the method comprising:

providing a holographic antenna, wherein the holographic antenna includes:

a transmission line;

a plurality of interdigital capacitor (IDC) slots respectively formed along the transmission line; and a single active tuning device connected to each IDC slot of the plurality of IDC slots, wherein each active tuning device is configured to provide a holographic pattern on the plurality of IDC slots in response to the holographic antenna transmitting or receiving an electromagnetic signal; and controlling the holographic pattern on the plurality of IDC slots to scan an electromagnetic beam by the holographic antenna in response to the holographic antenna transmitting or receiving the electromagnetic signal, wherein said controlling the holographic pattern on the plurality of IDC slots comprises controlling operation of each active tuning device.

18. The method of claim 17, wherein each IDC slot comprises a predetermined slit size, and wherein the method further comprises controlling an amount of electromagnetic radiation or signal leakage from a particular IDC slot by changing the predetermined slit size of the particular IDC slot.

19. The method of claim 17, further comprising tuning the active tuning devices connected to the plurality of IDC slots to reconfigure an electromagnetic beam pattern of the holographic antenna.

20. The method of claim 17, further comprising:

providing an array of holographic antenna elements; and adjusting a plurality of adjustable phase shifters, wherein each adjustable phase shifter from the plurality of adjustable phase shifters is connected to an end of each holographic antenna element from the array of holographic antenna elements to provide electromagnetic beam steering by the array of holographic antenna elements.

21. The holographic antenna of claim 1, wherein each IDC slot comprises a substantially serpentine shape or a square-wave shape extending a predetermined length and wherein the single active tuning device is located at approximately a center of the predetermined length.

* * * * *